United States Patent [19]

Zafiroglu

[11] Patent Number: 5,041,255

[45] Date of Patent: Aug. 20, 1991

[54] SOFTENING AND BULKING STITCHBONDED FABRICS

[75] Inventor: Dimitri P. Zafiroglu, Wilmington, Del.

[73] Assignee: E. I. du Pont de Nemours and Company, Wilmington, Del.

[21] Appl. No.: 388,174

[22] Filed: Jul. 31, 1989

[51] Int. Cl.[5] ..... B29C 55/18

[52] U.S. Cl. ..... 264/288.8; 26/51; 26/105; 264/290.2; 264/342 RE

[58] Field of Search ..... 264/288.8, 342 RE, 280, 264/DIG. 71, DIG. 73, 290.2; 425/396; 26/63

[56] References Cited

U.S. PATENT DOCUMENTS

| | | | |
|---|---|---|---|
| 3,233,029 | 2/1966 | Rasmussen | 264/288.8 |
| 3,296,351 | 1/1967 | Rasmussen | 264/288.8 |
| 3,427,376 | 2/1969 | Dempsey | 264/282 |
| 3,624,874 | 12/1971 | Lachenauer | 26/63 |
| 3,772,417 | 11/1973 | Vogt | 264/230 |
| 3,811,979 | 5/1974 | Dempsey et al. | 156/181 |
| 4,187,343 | 2/1980 | Akiyama et al. | 264/288.8 |
| 4,223,059 | 9/1980 | Schwarz | 428/198 |
| 4,329,315 | 5/1982 | Brower et al. | 264/342 RE |
| 4,438,167 | 3/1984 | Schwarz | 428/138 |
| 4,443,513 | 4/1984 | Meitner et al. | 264/288.8 |
| 4,652,322 | 3/1987 | Lim | 264/288.8 |
| 4,704,321 | 11/1987 | Zafiroglu | 428/230 |
| 4,737,394 | 4/1988 | Zafiroglu | 428/102 |
| 4,773,328 | 9/1988 | Zafiroglu | 66/192 |
| 4,806,300 | 2/1989 | Walton et al. | 264/288.8 |

OTHER PUBLICATIONS

K. W. Bahlo, "New Fabrics without Weaving", Papers for the American Association for Textile Technology, Inc., pp. 51–54 (Nov. 1965).

*Primary Examiner*—Jeffery Thurlow

[57] ABSTRACT

A process in which a stitchbonded fabric is stretched and then allowed to recover from the stretch decreases the stiffness of the fabric while greatly increasing its thickness and bulk.

17 Claims, 2 Drawing Sheets

SOFTENING AND BULKING STITCHBONDE FABRICS

BACKGROUND OF THE INVENTION

1. Field of the Invention

This invention relates to a process for reducing the stiffness of a nonwoven fabric. More particularly, the invention concerns such a process which subjects a stitchbonded nonwoven fabric to a stretching and relaxing treatment that not only makes the stitchbonded fabric less stiff, but also greatly increases its specific volume.

2. Description of the Prior Art

Stitchbonded fabrics and methods for producing them are known, as for example from K. W. Bahlo, "New Fabrics without Weaving" Papers of the American Association for Textile Technology, Inc. pp. 51–54 (November 1965). Such fabrics are made by multi-needle stitching of various fibrous substrates with elastic or non-elastic yarns, as disclosed, for example, by the present inventor in U.S. Pat. Nos. 4,704,321, 4,737,394 and 4,773,328. In the finishing operations, such as heat setting, drying or chemical finishing, the fabric may be heated and cooled while being held in a stretched condition, usually on a tenter frame. However, such operations usually result in undesirable stiffening of the fabric. Even without such treatments, known stitchbonded fabrics having unit weights of less than about 200 grams per square meter, generally are quite stiff and dense.

Supple fabrics of high bulk are particularly desired for certain apparel fabrics, insulating fabrics, powder puffs, dust cloths, cosmetics wipes, and the like. Accordingly, a purpose of this invention is to provide a process for decreasing the stiffness and density of a stitchbonded fabric.

Various methods have been suggested in the art for decreasing the stiffness of a nonwoven fabric by working the fabric. Such processes involving passage of a nonwoven fabric between peg rolls or button-breaker rolls, or through crepers, or the like, have been disclosed, for example, by Dempsey, U.S. Pat. No. 3,811,979 and Dempsey et al, U.S. Pat. No. 3,427,376.

Methods for stretching fabrics also are known. Such methods include: (a) long span, longitudinal stretching between two pairs of nip rolls operating at different speeds; (b) long span, transverse stretching on a tenter frame; (c) transverse microstretching between a pair of rolls, each roll having circumferentially extending and axially spaced grooves and lands which intermesh with the corresponding grooves and lands on the other roll, as disclosed by Lachenauer, U.S. Pat. No. 3,624,874; and (d) longitudinally and transversely microstretching in sequence, first between intermeshing axially grooved rolls and then between circumferentially grooved rolls, as disclosed by Schwarz, U.S. Pat. Nos. 4,223,059 and 4,438,167.

SUMMARY OF THE INVENTION

The present invention provides a process for decreasing the stiffness and increasing the specific volume of a stitchbonded nonwoven fabric. The process comprises stretching the stitchbonded fabric by 15 to 50%, preferably 15 to 25%, parallel to the direction of the stitching or transverse thereto, and then allowing the fabric to relax. The stretching and relaxation steps are performed with the fabric in a substantially non-heated condition. After relaxation, the fabric recovers at least one-half, preferably at least three-quarters, of the applied stretch. As a result of the stretching and relaxation, the thickness and specific volume of the fabric are each increased by a factor of at least 1.5, and preferably at least 2, and fabric stiffness is reduced to no more than 70%, preferably to no more than 50% of its original stiffness, as indicated by bending length measurements.

BRIEF DESCRIPTION OF THE DRAWINGS

The invention will be more readily understood by reference to the drawings, which illustrate various means for performing stretching and relaxing of stitchbonded fabrics in accordance with the present invention. Specifically.

DETAILED DESCRIPTION OF PREFERRED EMBODIMENTS

Figure 1:
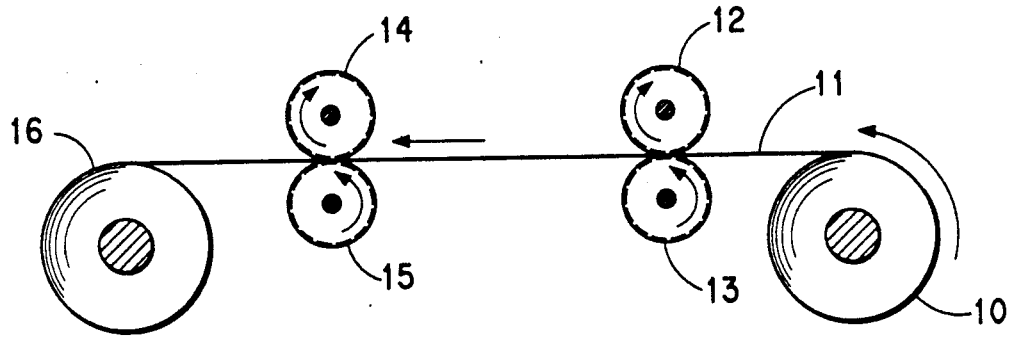
FIG. 1 illustrates long-span, longitudinal (also referred to herein as "machine-direction" or "MD") stretching between pairs of nip-rolls.

In accordance with the present invention, a stitchbonded fabric is made less stiff and has its specific volume increased by a process which comprises stretching the fabric in a given direction by 15% to 50%, and then allowing the fabric to relax, whereby the fabric recovers at least half, preferably at least 75%, of the stretch and returns to within 15% of its original planar surface area and experiences a gain of at least 100% in thickness. Most preferably, the fabric recovers substantially completely from the stretch and returns to its original planar dimension.

Stitchbonded fabrics that can be softened by the process of the present invention are made by conventional multi-needle stitching techniques applied to fibrous substrates. Such fibrous substrates can be in the form of carded webs, cross-lapped webs, nonbonded or lightly bonded nonwoven sheets, lightly hydraulically entangled or spunlaced webs, or the like, of staple fibers or continuous filaments. The multi-needle stitching can be done with non-elastic or elastic yarns. The fibrous substrates suitable for use in the present invention usually weigh in the range of 25 to 250 grams per square meter. The stitching yarns seldom amount to more than 20% of the weight of the stitchbonded fabric; 2 to 10% is more usual. The stitching yarns usually form about 2 to 10 longitudinal rows of stitches per centimeter across the width of the fabric, with each row containing about 2 to 10 stitches per cm of row length. Chain or tricot stitches are customarily employed.

The choice of longitudinal (MD) stretching or transverse (XD) stretching depends on the directionality or arrangement of the fibers of the stitchbonded fabric.

MD stretching is employed when the fibers in the fabric are arranged mainly in the transverse (XD) direction and XD stretching is employed when the fibers are arranged mainly in the longitudinal (MD) direction. To determine the main direction in which the fibers of the fibrous web of the stitchbonded fabric are arranged, simple zero-span Instron tensile tests are performed on samples of the web, in the longitudinal (MD) direction and in the transverse (XD) direction. Then, the ratio of the MD-to-XD measured tensile strengths is calculated. When, the MD/XD ratio is in the range of about 0.8 to 1.2, the fibers are considered to be randomly or isotropically arranged, and MD or XD stretching of the fabric in accordance with the invention is equally effective in softening (i.e., reducing stiffness) and bulking (i.e., increasing specific volume) of the stitchbonded fabric. When the MD/XD tensile-strength ratio is greater than a 1.2, a majority of the fibers lie mainly in the longitudinal direction (MD) and transverse (XD) stretching is preferred. When the MD/XD tensile-strength ratio is 2.0 or higher, the fibers lie mainly in the longitudinal direction (MD) and transverse (XD) stretching is essential for superior softening and bulking of the fabric. Similarly, when the MD/XD tensile ratio is less than 0.8, the majority of the fibers lie in the transverse (XD) direction and MD stretching is preferred. When the MD/XD ratio is 0.7 or lower, the fibers lie mainly XD, and MD stretching is essential for superior softening and bulking of the fabric.

The choice of whether to use long-span stretching or short-span stretching of the stitchbonded fabric depends mainly on the uniformity and method by which the fibrous substrate was formed. Long-span stretching can be performed if the fabric is sufficiently uniform. If the fabric is somewhat nonuniform, short-span stretching is employed. A convenient test used by the present inventor for determining which technique is more suited for treating a particular stitchbonded fabric is a "hand grab-tensile test". This test is performed after it has been determined in which direction the stretching is to be performed. In this test, opposite ends of a sample of the fabric are gripped tightly, one end in each hand, and tension is applied by hand to the fabric. The fabric is held so that the tension applied by hand will be MD or XD, to correspond to the desired direction of stretching. The distance between the place where each end of the fabric has been grasped is measured. A moderate tensile pull is applied by hand to the grasped fabric. By changing the distance between grasp points and repeating the test a few times, a characteristic distance, referred to hereinafter as "$S_g$", can be determined at which the fibers and fabric start to pull apart nonuniformly. The nonuniform pulling apart can be due to a layered, overlapping structure or to thick and thin nonuniform areas within the fibrous web. However, to assure satisfactory stretching in accordance with the present invention, a convenient "rule of thumb" is that the stretching span on the stretching apparatus usually should be no greater than one half the distance determined in the "hand grab-tensile test", preferably less than one-quarter of that distance. The minimum span for use in stretching according to the invention, is preferably at least 1 centimeter. Stretching spans as large as 100 cm or more are generally useful. Spans of 1.5 to 30 cm are particularly preferred.

As noted above, in performing the process of the present invention, it is customary to stretch the stitchbonded fabric (a) in the direction that is perpendicular to the direction in which the majority of the fibers of the stitchbonded substrate lie and (b) over a stretching span that is much shorter than the "$S_g$" determined in the hand grab-tensile test.

Although this paragraph presents a mechanism which the inventor believes explains why stitchbonded fabrics are softened and bulked by his stretching and relaxing process, the scope of his invention is not intended to be limited by said proposed mechanism. The multi-needle stitching of a stitchbonded fabric divides the fibrous substrate of the fabric into a large number of small sub-regions which lie between the yarn-insertion points. The fibers of the fibrous substrate form a relatively flat and stiff planar structure. The fibers can slide along each other but cannot move across the inserted yarns. Thus, when the fabric is stretched, the amount of fiber within the small sub-areas between the yarns remains practically constant. When the fabric is stretched the position of the fibers in the stitchbonded substrate is substantially altered and substantially all weak bonds between web fibers are broken. Then after the stretching is completed and the fabric is allowed to relax, the inherent elastic recovery properties of network of stitched yarns (a) cause the yarns to retract, (b) force the structure to return to nearly its original planar dimensions, and (c) allows the loosened fibers within the small sub-regions between the rows of stitched yarns to gather, deform and project out-of-plane. The fabric thereby becomes significantly thicker and far less stiff. Because of the limited stretch involved in the process, the stitchbonded fabric maintains its initial physical strength, integrity and uniformity.

Various types of stretching and relaxing apparatus suitable for use with the process of the invention will now be described in further detail with reference to the drawings.

Long-span stretching in the longitudinal (MD) direction between pairs of nip rolls is depicted in FIG. 1. A stitchbonded fabric 11, supplied from roll 10 is advanced successively between a first pair of elastomer-covered nip rolls 12 and 13 at a speed $v_1$ and then between a second pair of elastomer-covered nip rolls 14 and 15 at a speed $v_2$. Speed $v_2$ in the second pair of nip rolls is faster than the speed $v_1$ in the first pair of nip rolls, which causes the fabric to stretch. The imposed percent stretch is calculated by the equation:

$$\% \text{ stretch} = 100[(v_2/v1) - 1].$$

The stretching span is the distance between the two nips. The stretched fabric is forwarded from the second nip to a windup roll 16. The peripheral speed of the windup roll 16 is sufficiently slower than the speed of the fabric in the second nip, to permit the fabric to relax fully in the passage from the second nip to the windup.

Figure 2:
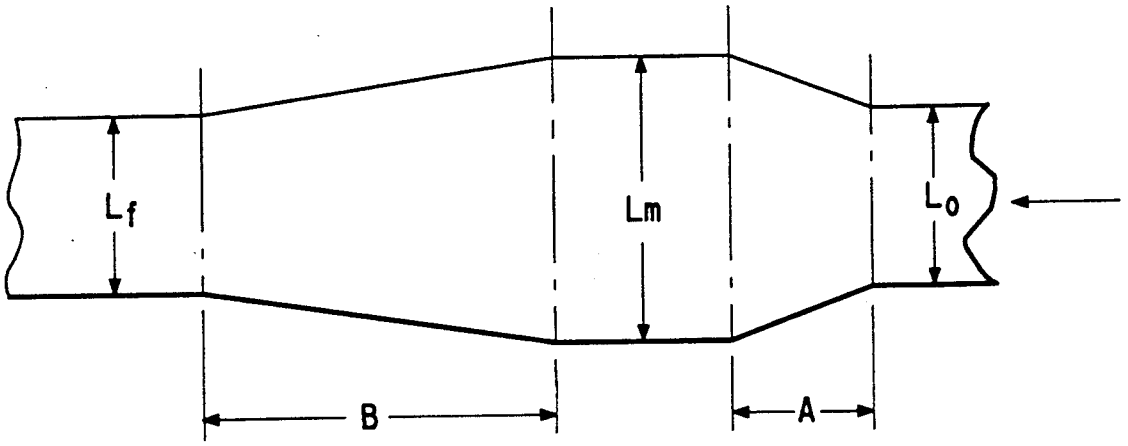
FIG. 2 illustrates the width changes that occur when a stitchbonded fabric undergoes long-span, transverse (also referred to herein as "cross-machine" or "XD") stretching on a tenter frame.

Long-span transverse stretching in a tenter is depicted in FIG. 2. FIG. 2 is a plan view of a fabric as it passes through a tenter. The stretching span is the maximum distance between the edges of the sheet, $L_m$. A fabric of original width $L_o$ is grasped at its edges as it is fed to the tenter. During its passage through zone A of the tenter, the sheet is stretched to the maximum width $L_m$. The percent stretch imposed by the tenter is calculated by the equation:

$$\% \text{ stretch} = 100[(L_s/L_o) - 1[.$$

In zone B of the tenter the width of the fabric is permitted to relax to a final width $L_f$ which is close to its original width.

Figure 3:
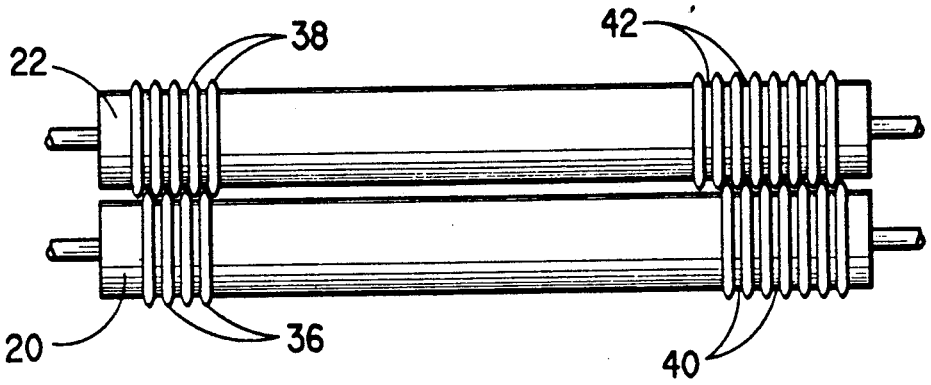
FIG. 3 illustrates a pair of intermeshing, circumferentially ribbed rolls suitable for MD short-span stretching a stitchbonded fabric.
Figure 4:
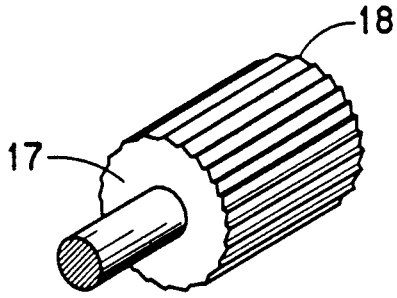
FIG. 4 illustrates an axially ribbed roll suitable for use with a similarly ribbed, intermeshing roll to XD short-span stretch a stitchbonded fabric.
Figure 5:
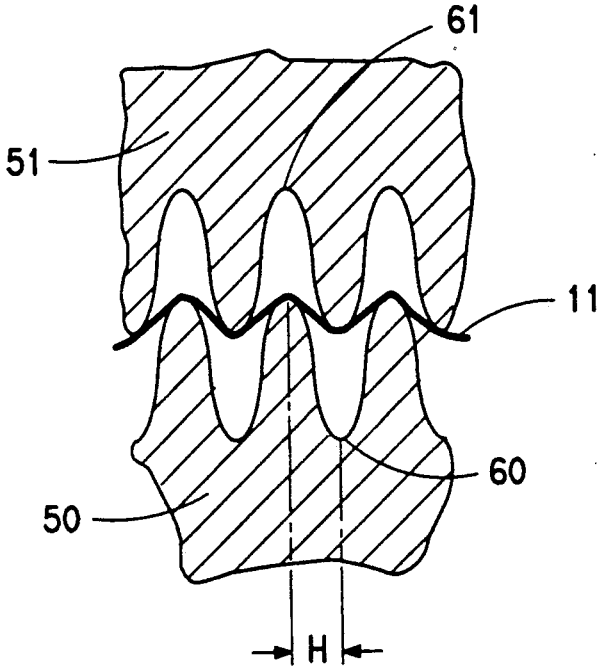
FIG. 5 illustrates in enlarged schematic cross-section the distances between ribs of intermeshing rollers of FIGS. 3 and 4, needed for calculating the stretching span and percent stretch applied to the stitchbonded fabric.

FIGS. 3, 4 and 5 illustrate equipment intended for short-span stretching of stitchbonded fabric.

FIG. 3 depicts a pair of intermeshing circumferentially ribbed rolls 20 and 22 respectively having ribs 36 and 38 and grooves 40 and 42. These rolls are suitable for XD short-span stretching. Contours and dimensions for the lands and grooves suited for stretching a given stitchbonded fabric are readily determinable by a few trials, starting with dimensions that would impose a stretch of about one-quarter of the "hand grab-tensile test" $S_g$, determined as described above. The required ribs can be formed on a cylindrical roll by machining or by coaxially mounting a series of alternating disks and spacers on a rotatable shaft.

FIG. 4 is an isometric view of a roll 17 which has axial ribs 18 on its surface. When used with an intermeshing companion roll of substantially the same design, such axially ribbed rolls can impose longitudinal (MD) short-span stretching on a stitchbonded fabric.

FIG. 5 is an enlarged schematic cross-section of two intermeshing ribbed rolls 50 and 51 which are suitable for short-span stretching of stitchbonded fabric 11 in accordance with the present invention. To calculate the percent stretch applied by intermeshing ribbed rolls, the following equation is used:

$$\% \text{ stretch} = 100[(y/H) - 1]$$

where y = the distance along the centerline of the fabric between the bottom of a groove 60 in one roll 50 to the bottom of the next groove 61 located in the other roll 51; and H = the projected horizontal half-spacing between successive grooves in the roll.

Short-span stretching of stitchbonded fabric by the process of the invention can be accomplished with apparatus such as that depicted in FIG. 1, with the first pair of nip rolls 12 and 13 replaced by a pair of ribbed rolls (e.g., 20 and 22 of FIG. 3) and operating the second pair of nip rolls 14 and 15 at the same peripheral speeds as the ribbed rolls.

In the examples which follow, certain characteristics of stitchbonded and softened fabrics are reported. These were measured by the following methods. Unit weights of the starting webs and stitchbonded fabrics before and after softening are measured in grams per square meter in accordance with ASTM D 3776-79. ASTM is an abbreviation for the American Society of Testing Materials. Thickness is measured in centimeters with a conventional spring gauge having a 0.5-inch (1.27-cm) diameter cylindrical foot loaded with 10 grams. Specific volume (or "bulk") in $cm^3$/gram is calculated by dividing the sample thickness by its unit weight. Sample stiffness is reported in terms of bending length which is measured in accordance with ASTM D 1388, Option A, Cantilever Test.

EXAMPLES 1-5

These examples demonstrate the surprisingly large and desirable increases in thickness and specific volume (i.e., bulk) that accompany the softening of stitchbonded fabrics by the process of the invention. The examples illustrate the process with a variety of stitchbonded fabrics that are subjected to stretching MD or XD over long or short spans.

Each of the stitchbonded fabrics was prepared by feeding a substantially nonbonded fibrous web in the MD to a Malimo multi-needle stitching machine. The machine, equipped with a 12-gauge needle bar (i.e., 12 needles per 25 mm XD) inserted 4.5 chain or tricot stitches per cm MD to create 4.8 rows of stitches per cm XD. Further details of the types of fibrous webs and stitching yarns from which the stitchbonded fabrics were fabricated and of the particular types of equipment used for softening the fabrics are described in the Examples. Table I summarizes various characteristics of the stitchbonded fabrics prior to softening. Table II summarizes the results obtained when the fabrics were stretched and relaxed in accordance with the process of the invention.

EXAMPLE 1

A 48 g/$m^2$ sheet of nonbonded, lightly consolidated, flash-spun strands of polyethylene film fibrils, prepared by the general methods of Blades et al, U.S. Pat. No. 3,081,519, and described in further detail in Lee, U.S. Pat. No. 4,554,207, column 4, line 63 through column 5, line 60, which disclosures are hereby incorporated by reference, was multi-needle chain-stitched with elastic threads of 22 dtex spandex yarn (Lycra® sold by E. I. du Pont de Nemours and Company) that was covered with 44 dtex nylon. The elastic stitching threads were introduced under high tension so that only 10% residual stretch remained in the threads. The thusly prepared stitchbonded fabric had a MD/XD fiber directionality of 2.3, an XD "hand-stretch span" of about 5-15 cm, a thickness of 0.058 cm, a specific volume of 12.3 g/$cm^3$ and bending lengths of 2.6 cm MD and 4.6 cm XD.

The stitchbonded fabric was stretched XD between a pair of intermeshing "disk rolls" (similar to the ribbed rolls depicted in FIGS. 3 and 5). The disks of each roll were each mounted on a 1-inch (2.5-cm) diameter coaxial shaft. Each disk was 4 inches (10.2 cm) in diameter and ¾ inch (1.9 cm) thick and had a ⅜-inch (0.95-cm) radius on its outer periphery. The disks of the upper and lower rolls intermeshed to a depth of ¾ inch (1.9 cm). Center planes of successive intermeshing disks were 1 inch (2.5 cm) apart. Passage of the stitchbonded fabric between the disk rolls at a speed of 9.1 m/min imposed a 25% XD stretch on the fabric. After passage of the fabric between the disk rolls, the fabric was allowed to recover on its way to windup.

As a result of the above-described treatment, the bending length of the fabric in both directions was reduced by a factor of greater than 2, the specific volume and thickness each increased by a factor of greater than 2.6. This softening and bulking of the fabric was accomplished with little change in the tensile strength of the fabric. In contrast to the successful softening and bulking accomplished through XD small-span stretching, as just described, satisfactory stretching without tears and uneven deformation, were not achieved when the stitchbonded fabric was subjected to long span MD stretching between pairs of nip rolls (FIG. 1) separated by 1 foot (30 cm) and long span XD stretching on a tenter (FIG. 2).

Further details of the successful softening are summarized in Table II.

EXAMPLE 2

A 51 g/m$^2$ carded web, consisting essentially of 75 weight percent Type-72 Orlon ® acrylic staple fiber of 1.65 dtex and 25% Type-262 Dacron ® "low-melting" polyester staple fiber, (both fibers commercially available from E. I. du Pont de Nemours & Co.) was lightly thermally bonded at a temperature of 150° C. and pressure of 100 psi (689 kPa) and then stitchbonded as described in Example 1. The carded web was very uniform (as indicated by its large hand-stretch span of about 50 cm MD and XD) but had a high MD/XD fiber directionality (6.5). Because of the high MD fiber directionality, MD stretching was impractical. However, fully satisfactory softening and bulking were achieved with Sample 2a by XD tentering with a 40% imposed stretch and with Sample 2b by XD disk-roll softening, in the same manner as was employed in Example 1. As a result of the treatment, the bending length of each sample was decreased by at least a factor of two and the thickness and specific volume of each sample each increased by a factor of more than 2.25.

EXAMPLE 3

A 153-g/m$^2$ carded web, consisting essentially of 75 weight percent 3.3 dtex, 3.8 cm-long Type-26 nylon staple fiber and 25% 3.3 dtex, 7.6-cm long Type-262 Dacron ® polyester staple fiber (both fibers sold by E. I. du Pont de Nemours & Co.) was prepared on a J. D. Hollingsworth-Hergeth card equipped with a "Doffmaster" reorienting roller. The web was lightly thermally bonded at a temperature of 150° C. and pressure of 100 psi (689 kPa) and then multi-needle stitched as in Example 1, except that a tricot stitch was used instead of the chain stitch of Example 1 and the stitching thread was a 154-dtex, textured nylon yarn instead of the covered spandex yarn. The intermeshing disk rolls apparatus described in Example 1 was employed to short-span XD stretch the stitchbonded fabric. Characteristics of the stitchbonded starting fabric are summarized in Table I; the results of the stretching and relaxing treatment is summarized in Table II. As in the preceding examples, note the large decreases in bending length (i.e., stiffness) and large increases (by a factor of almost 3) in thickness and specific volume, that result from the treatment in accordance with the invention.

EXAMPLE 4

A 142-g/m$^2$ cross-lapped carded web, consisting essentially of 75 weight percent 1.65 dtex, 3.8 cm-long Type-26 nylon staple fiber and 25% 3.3 dtex, 7.6-cm long Type-262 Dacron ® polyester staple fiber (both fibers sold by E. I. du Pont de Nemours & Co.) was lightly needle-punched to 7.5 penetrations per cm$^2$ (48/in2) and then multi-needle stitched as in Example 3 with 44 dtex Lycra ® spandex yarn. The yarn after stitching still had a residual stretch of greater than 200%. The fibers of the stitchbonded substrate were highly directional in the XD. Accordingly, the fabric was softened by stretching and relaxing in the MD; Sample 4a, by long-span MD stretching between pairs of nip rolls separated by 30 cm (see FIG. 1) and Sample 4b, by a passage between a pair of intermeshing "finned rolls", which simulate the action of the axially ribbed roll depicted in FIG. 4. Each of the pair of intermeshing "finned rolls" was a 7.6-cm (3-inch) diameter cylindrical roll having eight equally spaced, 3.8-cm (1.5-inch) long, 1.9-cm ($\frac{3}{4}$-inch) thick fins projecting radially from the cylinder surface. The tip of each fin has a 0.95-cm ($\frac{3}{8}$-inch) radius. The fins intermesh to a depth of about 1.9 cm ($\frac{3}{4}$ inch) which imposes a stretch of about 25% MD on the fabric. Tables I and II, respectively, summarize characteristics of the stitchbonded starting sheet and the highly satisfactory softening and bulking results.

EXAMPLE 5

A 31 g/m$^2$ nonwoven sheet of substantially nonbonded, randomly arrayed, continuous polyester filaments of 2.0 dtex (available from Reemay Inc., Old Hickory, Tennessee) was stitchbonded as in Example 4, except that a chain stitch was used instead of a tricot stitch. As can be seen from the characteristics summarized in Table I, the fibers of the fibrous substrate are highly isotropic (MD/XD fiber directionality value very near 1.0) and the substrate is very uniform (high hand stretch spans MD and XD). Samples of this stitchbonded starting fabric were softened and bulked by stretching and relaxing treatments that included MD long-span stretching between pairs of nip rolls (Sample 5a), MD short-span stretching with intermeshing finned rolls (Sample 5b), XD long-span stretching on a tenter (Sample 5c) and short-span stretching with intermeshing disk rolls. The treatments caused (1) sample stiffness to be reduced to a value in the range of 27 to 59% of the original stiffness, (2) sample thickness to be increased to about 280 to 340% of the original thickness and (3) sample specific volume also to increase to about 290 to 340% of the original value.

TABLE I

| Starting Stitchbonded Samples | Example no. | | | | |
|---|---|---|---|---|---|
| | 1 | 2 | 3 | 4 | 5 |
| Web weight, g/m$^2$ | 48 | 51 | 153 | 142 | 31 |
| Multi-needle stitching | | | | | |
| Yarn type | a | a | b | c | c |
| Stitch type | chain | chain | tricot | tricot | chain |
| Stitches/cm MD | 4.5 | 4.5 | 4.5 | 4.5 | 4.5 |
| Rows/cm XD | 4.7 | 4.7 | 4.7 | 4.7 | 4.7 |
| Fiber MD/XD directionality | 2.3 | 6.5 | 2.1 | 0.23 | 0.95 |
| Hand-stretch span* | | | | | |
| MD, cm | 5 | >50 | ns | >50 | 15 |
| XD, cm | 8 | >50 | 5 | >50 | 35 |
| Thickness, cm | 0.058 | 0.104 | 0.122 | 0.130 | 0.046 |
| Specific volume, cm$^3$/g | 12.3 | 20.4 | 8.0 | 9.1 | 15.0 |
| Bending length | | | | | |
| MD, cm | 2.6 | 2.9 | 3.1 | 3.0 | 1.5 |
| XD, cm | 4.6 | 3.4 | 2.3 | 2.7 | 1.9 |

Notes:
Yarn type:
a = 22-dtex Lycra ® wrapped with 44-dtex nylon
b = 154-dtex textured nylon
c = bare 44-dtex Lycra ®
MD = longitudinal ("machine") direction
XD = transverse ("cross-machine") direction
ns = not stretchable in this direction
*minimum values for measured hand-stretch spans

TABLE II

| Softening and Bulking Tests (Examples 1-5) | | | | | | | | | | |
|---|---|---|---|---|---|---|---|---|---|---|
| Sample | 1 | 2a | 2b | 3 | 4a | 4b | 5a | 5b | 5c | 5d |
| Stretching | | | | | | | | | | |

TABLE II-continued

| | Softening and Bulking Tests (Examples 1-5) | | | | | | | | | |
|---|---|---|---|---|---|---|---|---|---|---|
| Sample | 1 | 2a | 2b | 3 | 4a | 4b | 5a | 5b | 5c | 5d |
| Method | d | b | d | d | a | c | a | c | b | d |
| Span, cm | 2.5 | 51 | 2.5 | 2.5 | 15 | 2.5 | 15 | 2.5 | 51 | 2.5 |
| Percent | 25 | 40 | 25 | 25 | 20 | 25 | 30 | 25 | 25 | 25 |
| Direction | XD | XD | XD | XD | MD | MD | MD | MD | XD | XD |
| Results | | | | | | | | | | |
| $L_f/L_o$ | 1.05 | 1.10 | 1.05 | 1.00 | 1.00 | 1.00 | 1.12 | 1.10 | 1.03 | 1.00 |
| $A_f/A_o$ | 1.08 | 1.06 | 1.00 | 1.00 | 1.00 | 1.00 | 1.05 | 1.00 | 1.00 | 1.00 |
| $t_f/t_o$ | 2.65 | 2.24 | 2.39 | 2.90 | 2.76 | 2.85 | 2.78 | 3.44 | 3.06 | 3.17 |
| $V_f/V_o$ | 2.86 | 2.37 | 2.39 | 2.90 | 2.76 | 2.85 | 2.92 | 3.44 | 3.06 | 3.17 |
| $B_f/B_o$ | | | | | | | | | | |
| MD | 0.42 | 0.50 | 0.47 | 0.48 | 0.37 | 0.45 | 0.40 | 0.33 | 0.43 | 0.40 |
| XD | 0.45 | 0.49 | 0.45 | 0.48 | 0.36 | 0.32 | 0.27 | 0.35 | 0.59 | 0.54 |

Notes:
Method of stretching (equipment used)
a = nip rolls (FIG. 1)
b = tenter frame (FIG. 2)
c = ribbed rolls (FIG. 4, 5)
d = intermeshing disks (FIG. 3, 5)
MD = longitudinal ("machine") direction
XD = transverse ("cross-machine") direction
Subscript f = final value, after stretching
Subscript o = original value, before stretching
L = fabric length in stretching direction
A = fabric area
t = fabric thickness
V = fabric specific volume
B = cantilever test bending length

I claim:

1. A process for softening and bulking a stitchbonded nonwoven fabric which weighs in the range of 25 to 250 g/m$^2$ and in which the stitching yarns form 2 to 10 longitudinal rows of stitches per cm across the fabric which contain 2 to 10 stitches per cm of row length, the process comprising linearly stretching the fabric by 15 to 50% in directions parallel and/or transverse to the longitudinal rows of stitches and then releasing the fabric from the stretch and allowing the fabric to relax, the fabric being in a substantially non-heated condition during the stretching, releasing and relaxing whereby the fabric recovers at least half of the applied stretch, the fabric surface area is increased by no more than 15%, and fabric thickness is increased by at least 100%.

2. A process of claim 1 wherein the fabric is stretched within a span of 1 cm to 100 cm and the imposed stretch is in the range of 20 to 40 percent.

3. A process of claim 2 wherein the stretching span is 1.5 cm to 30 cm.

4. A process of claim 1, 2 or 3 wherein the stretch is applied in the longitudinal direction of the stitchbonded fabric when the fiber directionality of the fabric is in the transverse direction.

5. A process of claim 1 wherein a longitudinal stretch is applied to the fabric by passing through a first and second pair of rotating nip rolls, the rotational speed of the second pair of nip rolls being in the range of 1.15 to 1.5 times rotational speed of the first pair of nip rolls, the nips being spaced 10 to 100 cm apart.

6. A process of claim 4 wherein the longitudinal stretch is applied by intermeshing axially ribbed rollers.

7. A process of claim 1, 2 or 3 wherein the stretch is applied in the transverse direction of the stitchbonded fabric when the fiber directionality of the stitchbonded fabric is in the longitudinal direction.

8. A process of claim 7 wherein the transverse stretch is applied by intermeshing circumferentially ribbed rollers.

9. A process of claim 7 wherein the transverse stretch is applied by spaced discs mounted on a pair of cooperating rollers and arranged to intermesh with corresponding disks of the of the cooperating roller.

10. A process of claim 1 wherein a transverse stretch is applied to the fabric by a tenter.

11. A process in accordance with claim 1 wherein the stitching yarns are elastic threads.

12. A process in accordance with claim 1 or 11 wherein the fabric recovers at least 75% of the stretch.

13. A process in accordance with claim 1 or 11 wherein the fabric recovers substantially completely from the stretch, returns substantially to its original planar dimensions and increases to about 280 to 340% of its original thickness.

14. A process of claim 6 wherein the intermeshing extends to a depth in the range of 1.25 to 2.5 cm.

15. A process of claim 14 wherein the intermeshing depth is about 1.9 cm.

16. A process of claim 9 wherein the intermeshing extends to a depth in the range of 1.25 to 2.5 cm.

17. A process of claim 16 wherein the intermeshing depth is about 1.9 cm.

* * * * *